US006376689B1

(12) United States Patent
Muralidhara et al.

(10) Patent No.: US 6,376,689 B1
(45) Date of Patent: Apr. 23, 2002

(54) REMOVAL OF GUM AND CHLOROPHYLL-TYPE COMPOUNDS FROM VEGETABLE OILS

(75) Inventors: Harapanahalli S. Muralidhara, Plymouth; Gary F. Seymour, Howard Lake; Bassam F. Jirjis, Plymouth; Dennis D. Otten, Elk River, all of MN (US); Xiaohong Luo, Fresno, CA (US)

(73) Assignee: Cargill, Incorporated, Wayzata, MN (US)

( * ) Notice: Subject to any disclaimer, the term of this patent is extended or adjusted under 35 U.S.C. 154(b) by 0 days.

(21) Appl. No.: 09/388,515

(22) Filed: Sep. 2, 1999

(51) Int. Cl.[7] ..... C11B 3/04
(52) U.S. Cl. ..... 554/188; 554/190; 554/191
(58) Field of Search ..... 554/124, 155, 554/175, 176, 179, 190, 192, 188, 191

(56) References Cited

U.S. PATENT DOCUMENTS

| | | | | |
|---|---|---|---|---|
| 4,049,520 | A | 9/1977 | Wagner | 204/186 |
| 4,240,972 | A | 12/1980 | Mag et al. | 260/424 |
| 4,280,962 | A | 7/1981 | Watanabe et al. | 260/424 |
| 4,623,489 | A | 11/1986 | Rivers, Jr. | 260/424 |
| 4,698,185 | A | 10/1987 | Dijkstra et al. | 260/403 |
| 4,781,864 | A | 11/1988 | Pryor et al. | 260/420 |
| 4,794,011 | A | 12/1988 | Schumacher | 426/448 |
| 4,981,620 | A | 1/1991 | Anghelescu et al. | 260/420 |
| 5,077,071 | A | 12/1991 | Strop | 426/417 |
| 5,231,201 | A | 7/1993 | Welsh et al. | 554/191 |
| 5,239,096 | A | 8/1993 | Rohdenburg et al. | 554/176 |
| 5,248,799 | A | 9/1993 | Schmutzler | 554/191 |
| 5,286,886 | A | 2/1994 | Van de Sande et al. | 554/192 |
| 5,298,639 | A | 3/1994 | Toeneboehn et al. | 554/192 |
| 5,315,021 | A | 5/1994 | Beharry et al. | 554/190 |
| 5,516,924 | A | 5/1996 | Van de Sande et al. | 554/192 |
| 5,696,278 | A | 12/1997 | Segers | 554/176 |

FOREIGN PATENT DOCUMENTS

| | | |
|---|---|---|
| EP | 0 187 877 A1 | 1/1985 |
| EP | 0 195 991 A2 | 3/1986 |
| EP | 0212 391 A2 | 3/1987 |
| EP | 0 473 985 A2 | 3/1992 |
| JP | 7-197075 | 8/1995 |
| JP | 7-197076 | 8/1995 |
| WO | WO 87/06431 | 11/1987 |
| WO | WO 94/21765 | 9/1994 |

OTHER PUBLICATIONS

Translation for JP–7–197076, Refining Process for Edible Vegetable Oil, Aug. 1995.*

Bergman, L.O. and Johnsson, A., "A New Method for Refining Edible Oils and Fats—The Zenith Process," *Fette Seifen Anstrichmittel,* vol. 66, No. 3, pp. 203–06 (1964) (Translation).

Mag, T.K., "Principles of Canola Oil Processing," T. Mag/Associates, Consulting Inc., Canada pp. 1–13.

Szemraj, Helena, "Review of Technological Methods for Descumming Vegetable Oils," Institute of the Fat and Oil Industry, pp. 1–10 (1973) (Translation).

Szemraj, Helena, "Phosphoric Acid As A Descumming Agent for Rapeseed Oil," Institute Of The Fat and Oil Industry, pp. 1–14 (1973) (Translation).

Szemraj, Helena, "Effect of Phosphoric Acid On The Color Change in Rape Seed Oil," Institute of the Fat Industry, Warsaw, pp. 1–12 (1974) (Translation).

* cited by examiner

*Primary Examiner*—Deborah D. Carr
(74) *Attorney, Agent, or Firm*—Fitch, Even, Tabin & Flannery

(57) ABSTRACT

A single-step acid degumming/decolorizing process removes chlorophyll-type compounds from vegetable oils from seeds, especially frost damaged seeds which have large amounts of chlorophyll-type compounds. A mixture of aqueous sulfuric and phosphoric acids is blended with the oil to remove chlorophyll-type compounds from the oil. The purified oil has less than about 5 ppm chlorophyll-type compounds, less than about 50 ppm phosphorus and less than about 1.0 weight percent free fatty acids.

20 Claims, No Drawings

REMOVAL OF GUM AND CHLOROPHYLL-TYPE COMPOUNDS FROM VEGETABLE OILS

FIELD OF THE INVENTION

The invention is directed to the removal of gum and chlorophyll-type compounds from vegetable oils from seeds, especially frost damaged seeds which have large amounts of chlorophyll. More particularly, a single-step acid degumming/decolorizing process is provided using a mixture of aqueous sulfuric and phosphoric acids. The purified oil has less than about 5 ppm chlorophyll-type compounds, less than about 50 ppm phosphorus and less than about 1.0 weight percent free fatty acids.

BACKGROUND OF THE INVENTION

An early frost will damage vegetable seeds, such as canola seeds and soybeans. As a result of the frost damage, the seeds will have increased levels of chlorophyll. The frost damaged seeds typically have chlorophyll levels of about 30 ppm to about 80 ppm and greater. It is even possible to have chlorophyll levels of about 100 ppm or more along with about 1 to about 3 weight percent gum in the oil.

Specifications for Type 1 degummed canola oil allow up to only 30 ppm of chlorophyll. Current commercial processes for acid degumming of the extracted oil are not able to achieve this low level when using frost damaged seeds, which are classified as Type 2 and 3, as feedstock.

The standard commercial process for removal of chlorophyll includes acid activated clay bleaching. This process, however, is not effective for purifying oil extracted from frost damaged seeds because of the large amounts of clay that are required to produce bleached canola oil having less than 30 ppm of chlorophyll-type compounds. The large volume of clay needed makes treatment of frost damaged seeds very expensive. Moreover, the volume of clay required to decolorize may be so excessive, the process becomes commercially impractical. Thus, it is either not possible to produce purified, degummed oil to meet specifications when using frost damaged seeds as feedstock, or it is very cost prohibitive.

There is a need for a cost-effective process for treating oil extracted from vegetable seeds, especially frost damaged seeds, to provide a purified, degummed oil having a maximum of 30 ppm chlorophyll-type compounds.

SUMMARY OF THE INVENTION

The invention provides a method for removing gum and chlorophyll-type compounds from oil extracted from seeds, including canola seeds and soybeans, especially frost damaged seeds, to provide a purified, degummed oil. The degummed oil will have less than about 5 ppm chlorophyll-type compounds, less than about 50 ppm phosphorus and less than about 1.0 weight percent free fatty acids.

In a very important aspect of the invention, crude non-degummed vegetable oil, such as canola or soybean oil, containing chlorophyll-type compounds and gum is mixed with a mixture of aqueous sulfuric and phosphoric acid in a single-step acid degumming/ decolorizing purification process. The process does not require degummed oil, but rather is effective for the simultaneous removal of gum and chlorophyll-type compounds. The aqueous acids and water from the aqueous acids are in a ratio and in an amount which, when added to the oil, provides an acid/oil/water blend having a pH in the range of from about 1.5 to about 5 and which is effective for precipitating the gums and chlorophyll-type compounds from the vegetable oil. The precipitates are removed from the vegetable oil via centrifugation or filtration. Thereafter, the initially degummed oil is washed with water (pH of about 7–9) in an amount effective for raising the pH to at least from about 6 to about 7.5. In general, after acid degumming and decolorization, the initially degummed oil is washed with water in an amount of from about 10 weight percent to effectively remove most of the remaining gums from the decolorized, degummed oil and remove acids from the degummed oil, hence raising the pH of the oil to from about 6 to about 7.5. Only small amounts, if any, of chlorophyll are expected to be removed by water washing. The degummed/decolorized oil has less than about 5 ppm chlorophyll, less than about 50 ppm phosphorus and less than about 1.0 weight percent free fatty acids.

In another important aspect, the process proceeds without regard for lowering the moisture level in the crude vegetable oil prior to mixing with the acids or with the addition of water to effectively remove most of the gums. The moisture content of the oil may be up to about 0.5 weight percent. If the moisture content of the oil is greater than about 0.5 weight percent, the amount of sulfuric acidic must be increased accordingly. After the acids (which have some water) are mixed with the oil, the total amount of moisture in the process is less than about 1.0 weight percent.

In yet another important aspect, the process of the invention can be used to remove chlorophyll from frost damaged canola seeds that have very high levels of chlorophyll-type compounds. For example, typical canola seeds have up to about 30 ppm chlorophyll. In comparison, frost damaged seeds accumulate chlorophyll, and oils made from such seeds will have chlorophyll in amounts in excess of 100 ppm. In a surprising aspect, it is possible to process in accordance with the invention the oil from frost damaged seeds to provide a purified, degummed oil having no more than about 5 ppm chlorophyll-type compounds.

In another important aspect, a caustic solution may be mixed with the degummed oil after water washing if it is desirable to remove additional amounts of free fatty acids as precipitated soapstock. The decolorized, degummed oil is mixed with a caustic to neutralize free fatty acids. In an important aspect, the caustic is sodium hydroxide having a concentration of from about 14 to about 20 Baume (Be).

The pH of the process is carefully controlled at between about 1.5 and about 5 during acid mixing. By controlling the pH, the chlorophyll-type compounds are maintained in a precipitated form to ensure maximum separation. If the pH increases above about 5, the chlorophyll-type compounds become water soluble. At a pH less than about 1.5, browning, or other color changes, of the oil will occur.

The chlorophyll-type compounds removed as by-product from the oil may be further processed to provide purified chlorophyll. The chlorophyll can be purified using any known purification process. The purified chlorophyll then can be used to provide color to food and other products.

DETAILED DESCRIPTION OF THE PREFERRED EMBODIMENT

The process of the invention provides a one-step method of degumming and decolorizing non-degummed vegetable oil extracted from seeds. The chlorophyll-type compounds removed from the oil using the process of the invention may be further treated to further remove free fatty acids and provide .purified product.

Chlorophyll and chlorophyll-type compounds in seeds, such as canola seeds and soybeans, are mostly converted to pheophytin during seed conditioning that occurs before oil extraction. Pheophytin is the main chlorophyll species present in crude and degummed oil. Treating oil with strong acid, such as phosphoric acid, cleaves the phytyl group from pheophytin molecules to form pheophorbide. The pheophorbide becomes protonated under highly acidic conditions and precipitates from oil. Pheophorbide in its neutral form is not water soluble but becomes soluble in its protonated form in an acidic aqueous solution. When treated with caustic, such as sodium hydroxide, pheophorbide is converted to sodium pheophorbide and becomes water soluble.

In the process of removing gum and chlorophyll-type compounds from oil according to the invention, oil-insoluble pheophorbides are formed when mineral acids, such as sulfuric and phosphoric acid, are mixed with the oil. As used herein, "chlorophyll-type compounds" means chlorophyll compounds, including chlorophyll a and chlorophyll b, pheophorbides and other chlorophyll compounds and derivatives that may be present in the oil. "Decolorization", as used herein, means removal of chlorophyll-type compounds.

Crude vegetable oil containing at least about 1 to about 3 weight percent gum and chlorophyll-type compounds is purified in a single-step acid degumming/decolorizing process. The oil is mixed with a mixture of aqueous acids which are in amounts effective to precipitate gums and chlorophyll-type compounds present in the crude oil. The acids are concentrated sulfuric acid (96%) and phosphoric acid (75%). In general, the acids are in a ratio of from about 2:1 to about 1:2 and, when blended with the oil, are in an amount of from about 0.6 to about 0.8 weight percent, based upon the weight of the blend, to provide a pH range of from about 1.5 to about 5. In an important aspect, equal amounts of aqueous acids are mixed with the oil at intense or high shear conditions.

The acid mixture is blended with the oil at a time and temperature effective to precipitate the gums and oils. In general, the acids may be blended with the oil at a temperature of about 20° to about 50° C. for about 2 to about 6 hours. The acids precipitate the gums and chlorophyll-type compounds from the vegetable oil. The pH of the oil/acid blend is carefully controlled at between about 1.5 and about 5. A pH probe or other suitable method may be used to monitor and control pH. The pH of the oil/acid blend is controlled between this range to ensure that the chlorophyll-type compounds are maintained in a precipitated form for maximum separation. If the pH increases above about 5, the effectiveness of chlorophyll removal decreases. At a pH less than about 1.5, browning, or other color changes, of the oil will occur. In general, pH of the oil/acid blend is maintained between about 1.5 and about 3.

After acid mixing is complete, the precipitates are removed from the oil via centrifugation or filtration to provide a decolorized and initially degummed oil. A standard centrifuge may be used. Alternatively, the precipitates may be removed using membrane filtration.

Thereafter, the initially degummed oil is washed with water (pH of about 7–9), which washing is effective for increasing the pH of the oil to at least about 6 and for removing free fatty acids to no more than about 1.0 weight percent, based upon the weight of the oil. In general, after acid degumming, the degummed oil is washed with water to substantially remove the remaining gums from the acid degummed oil, as well as to raise the pH of the oil to from about 6 to about 7 and to lower the amount of free fatty acids in the oil to no more than about 1.0 weight percent, based upon the weight of the oil. (The initially degummed oil is washed with water at a ratio of about 1:10 water to oil. The degummed/decolorized oil has less than about 5 ppm chlorophyll, less than about 50 ppm phosphorus and less than about 1.0 weight percent free fatty acids.

The degummed oil is dried for a time and at temperature and vacuum effective for providing a moisture content of from about 0.2 to about 0.5 weight percent and preferably less than about 0.1 weight percent. In an important aspect, these conditions are about 10 to 15 minutes at from about 100° C. to about 110° C. and about 20 to about 25 mmHg.

The process permits removal of gum and chlorophyll-type compounds by mixing the acids with non-degummed oil without mixing the oil with other materials and without pretreatment of the oil. The process is effective for removing gum and oil at temperatures of 50° C. or less without subsequent treatment such as an alkali treatment to deacidify the acid/oil blend and/or subsequent treatment with bleaching clay. Moreover, the process proceeds without regard for lowering the moisture level in the crude vegetable oil prior to mixing with the aqueous acids to effectively remove most of the gum and chlorophyll-type compounds. The moisture content of the oil may be up to about 0.5 weight percent. If the moisture content of the oil is greater than about 0.5 weight percent, the amount of sulfuric acid must be increased accordingly. After the acids are mixed with the oil, the total amount of moisture in the process is less than about 1.0 weight percent, based on the weight of the oil, and may be from at least about 0.6 to 0.7 weight percent, based on the weight of the oil.

Because the process of the invention is effective for simultaneously removing gums and chlorophyll-type compounds from non-degummed oil having at least about 1 to about 3 weight percent gum, without reliance upon pretreatment or post alkali deacidification steps, and such oils having more than 30 ppm chlorophyll-type compounds and even from at least 80 ppm chlorophyll-type compounds, the process consists essentially of mixing sulfuric acid, phosphoric acid and vegetable oil having at least about 1 to about 3 weight percent gum to provide an acidic oil blend, the acids being in amounts and the blend being held for a time and temperature effective to precipitate gums and chlorophyll-type compounds present in the oil but not to substantially discolor the oil, such as browning the oil. After precipitation of the gum and chlorophyll-type compounds, the precipitated gums and chlorophyll-type compounds are removed from the acidic oil blend to provide an initially degummed vegetable oil. Thereafter the initially degummed oil is washed with water to raise the pH of the oil to at least about 6 and to remove gums to provide a purified oil having less than about 50 ppm phosphorus and less than about 5 ppm chlorophyll-type compounds.

If it is desired to remove additional amounts of free fatty acids, a caustic solution may be mixed with the degummed/decolorized oil after water washing. The oil is mixed with a caustic in a single step to neutralize free fatty acids and precipitate them as soapstock. In an important aspect, the caustic is sodium hydroxide having a concentration of from about 14 to about 20 Baume (Be). The sodium hydroxide is in an amount of from about 112 to about 120 weight percent of the free fatty acids present in the degummed/decolorized oil.

The chlorophyll-type compounds removed as by-product from the oil may be further processed to provide purified chlorophyll. The chlorophyll can be purified using any known purification process. The purified chlorophyll then can be used to provide color to food and other products.

What is claimed is:

1. A process which is effective for providing a decolorized and degummed vegetable oil having less than about 50 ppm phosphorus and less than about 5 ppm chlorophyll-type compounds from vegetable oil, the process comprising:

mixing sulfuric acid, phosphoric acid and vegetable oil having at least about 1.0 weight percent gum to provide an acidic oil blend, the acids being in amounts effective to precipitate gums and chlorophyll-type compounds present in the oil but not to substantially discolor the oil;

removing the precipitated gums and chlorophyll-type compounds from the acidic oil blend to provide an initially degummed vegetable oil;

washing the initially degummed vegetable oil with water to raise the pH of the oil to at least about 6 and to remove free fatty acids and remaining gums to provide a purified oil having less than about 50 ppm phosphorus and less than about 5 ppm chlorophyll-type compounds, wherein the initially degummed vegetable oil is degummed without an alkali treatment after mixing the oil with the sulfuric acid and phosphoric acid.

2. A process as recited in claim 1 wherein the vegetable oil contains more than about 100 ppm chlorophyll-type compounds.

3. A process as recited in claim 1 wherein the amount of acid mixed with the vegetable oil is effective to provide the acidic oil blend with a pH of from about 1.5 to about 5.0.

4. A process as recited in claim 3 wherein the weight amounts of sulfuric and phosphoric acids are about equal and the total amount of acids is about 0.8 weight percent, based upon the weight of the acidic oil blend.

5. A process as recited in claim 4 wherein the amount of water in the acidic oil blend is less than about 1.0 weight percent, based upon the weight of the acidic oil blend.

6. A process as recited in claim 5 wherein the dried purified oil further has less than about 1.0 weight percent free fatty acids, based upon the weight of the acidic oil blend.

7. A process as recited in claim 5 wherein the process further comprises adding caustic solution in an amount effective for removing free fatty acids after water washing.

8. A process as recited in claim 7 wherein the caustic solution is sodium hydroxide having a concentration of from about 14 to 20 Baume.

9. A process as recited in claim 1 wherein the process further comprises drying the purified oil for a time, temperature and pressure which is effective for providing a moisture content of less than about 0.1 weight percent and providing a dried purified oil having a phosphorus content of less than about 50 ppm and a chlorophyll content of less than about 5 ppm.

10. A process as recited in claim 7 wherein the process further comprises drying the purified oil for a time, temperature and pressure which is effective for providing a moisture content of less than about 0.1 weight percent and providing a dried purified oil having a phosphorus content of less than about 50 ppm and a chlorophyll content of less than about 5 ppm.

11. A process which is effective for providing a decolorized and degummed vegetable oil having less than about 50 ppm phosphorus and less than about 5 ppm chlorophyll-type compounds from vegetable oil, the process consisting essentially of mixing sulfuric acid, phosphoric acid and vegetable oil having at least about 1 to about 3 weight percent gum to provide an acidic oil blend, the acids being in amounts and the blend being held for a time and temperature effective to precipitate gums and chlorophyll-type compounds present in the oil but not to substantially discolor the oil such as browning the oil;

removing the gum and chlorophyll-type compounds, from the acidic oil blend to provide an initially degummed vegetable oil; and washing the initially degummed oil with water to raise the pH of the oil to at least about 6 and to remove free fatty acids and remaining gums to provide a purified oil having less than about 50 ppm phosphorus and less than about 5 ppm chlorophyll-type compounds.

12. A process as recited in claim 11 wherein the vegetable oil contains more than about 30 ppm chlorophyll-type compounds.

13. A process as recited in claim 11 wherein the vegetable oil contains more than about 100 ppm chlorophyll-type compounds.

14. A process as recited in claims 11, 12 or 13 wherein the vegetable oil is canola oil.

15. A process as recited in claims 11, 12 or 13 wherein the vegetable oil is soybean oil.

16. A process which is effective for providing a decolorized and degummed canola oil having less than about 50 ppm phosphorus and less than about 5 ppm chlorophyll-type compounds from canola oil the process comprising:

mixing sulfuric acid, phosphoric acid and canola oil having at least about 1.0 weight percent gum to provide an acidic oil blend, the acids being in amounts effective to precipitate gums and chlorophyll-type compounds present in the oil but not to substantially discolor the oil;

removing the precipitated gums and chlorophyll-type compounds from the acidic oil blend to provide an initially degummed canola oil;

washing the initially degummed canola oil with water to raise the pH of the oil to at least about 6 and to remove free fatty acids and remaining gums to provide a purified oil having less than about 50 ppm phosphorus and less than about 5 ppm chlorophyll-type compounds, wherein the initially degummed vegetable oil is degummed without an alkali treatment after mixing the oil with the sulfuric acid and phosphoric acid.

17. A process as recited in claim 16 wherein the canola oil contains more than about 100 ppm chlorophyll-type compounds.

18. A process as recited in claim 17 wherein the amount of acid mixed with the canola oil is effective to provide the acidic oil blend with a pH of from about 1.5 to about 5.0.

19. A process which is effective for providing a decolorized and degummed canola oil having less than about 50 ppm phosphorus and less than about 5 ppm chlorophyll-type compounds from canola oil, the process comprising:

mixing sulfuric acid, phosphoric acid and canola oil having at least about 1.0 weight percent gum and at least about 100 ppm chlorophyll to provide an acidic oil blend, the acids being in amounts effective to precipitate gums and chlorophyll-type compounds present in the oil but not to substantially discolor the oil;

removing the precipitated gums and chlorophyll-type compounds from the acidic oil blend to provide an initially degummed canola oil;

washing the initially degummed canola oil with water to raise the pH of the oil to at least about 6 and to remove free fatty acids and remaining gums to provide a purified oil having less than about 50 ppm phosphorus and less than about 5 ppm chlorophyll-type compounds, wherein the initially degummed vegetable oil is degummed without an alkali treatment after mixing the oil with the sulfuric acid and phosphoric acid.

20. A process which is effective for providing a decolorized and degummed canola oil having less than about 50 ppm phosphorus and less than about 5 ppm chlorophyll-type compounds from canola oil, the process consisting essentially of mixing sulfuric acid, phosphoric acid and canola oil having at least about 1.0 weight percent gum and at least about 100 ppm chlorophyll to provide an acidic oil blend, the acids being in amounts effective to precipitate gums and chlorophyll-type compounds present in the oil but not to substantially discolor the oil;

removing the precipitated gums and chlorophyll-type compounds from the acidic oil blend to provide an initially degummed canola oil;

washing the initially degummed canola oil with water to raise the pH of the oil to at least about 6 and to remove free fatty acids and remaining gums to provide a purified oil having less than about 50 ppm phosphorus and less than about 5 ppm chlorophyll-type compounds.

* * * * *